US005419720A

United States Patent [19]

Chen

[11] Patent Number: 5,419,720

[45] Date of Patent: May 30, 1995

[54] STRUCTURE OF JACK FOR MODULAR PLUGS

[76] Inventor: Michael Chen, No. 11, Alley 16, Lane 337, Sec. 1, Ta Tung Rd., Hsi Chih Chen, Taipei, Hsien, Taiwan

[21] Appl. No.: 214,192

[22] Filed: Mar. 16, 1994

[51] Int. Cl.[6] ..... H01R 23/02

[52] U.S. Cl. ..... 439/676; 439/701

[58] Field of Search ..... 439/676, 78, 79, 322, 439/324, 660

[56] References Cited

U.S. PATENT DOCUMENTS 5,244,412 9/1993 Hatch et al. ..... 439/676

5,304,074 4/1994 Andre et al. ..... 439/676

5,328,390 7/1994 Johnston et al. ..... 439/676

*Primary Examiner*—David L. Pirlot

*Attorney, Agent, or Firm*—Bacon & Thomas

[57] ABSTRACT

A jack for modular plugs, including a housing, a contact holder inserted into the housing and hooked by hooks on the housing, a plurality of contacts inserted into respective grooves and contact passage holes on the contact holder, and a cover fastened to the contact holder by hook joints to hold down the contacts, the contacts being linked at one end by a coupling portion for quick installation in the contact holder through a horizontal loading process.

5 Claims, 7 Drawing Sheets

STRUCTURE OF JACK FOR MODULAR PLUGS

BACKGROUND OF THE INVENTION

The present invention relates generally to electrical connectors, and more particularly to jacks for modular plugs.

Various modular plugs are known for use in connecting the conductors of multi-conductor cords to the conductors of printed circuit boards, such as in computers. A variety of jacks for modular plugs have been disclosed specifically for connection to printed circuit boards. These jacks commonly comprises a plurality of conductors having each one end welded to the printed circuit board and an opposite end for connecting the modular plug. U.S. Pat. No. 4,703,991 discloses a low profile jack for this purpose, which includes a plurality of jack contacts and a two-part housing, the contacts and housing parts being constructed so that the contacts are preferably completely enclosed within the housing with the jack at the same time having a low profile, i.e., a small height dimension. During the assembly process, jack contacts are inserted into respective bores on the inner housing part one by one from the top. The assembly process is time-consuming and complicated. When inserted, jack contacts may displace causing further welding process difficult to perform. Furthermore, before the outer housing part is fastened to the inner housing part, jack contacts are disposed on the outside, and therefore they may fall out of place.

SUMMARY OF THE INVENTION

It is the principal object of the present invention to provide a jack for modular plugs which eliminates the aforesaid drawbacks.

It is another object of the present invention to provide jack contacts for the jack which are linked at one end by a coupling portion for quick installation through a horizontal loading process.

It is another object of the present invention to provide a contact holder and a cover for the jack which are formed with a respective L-shaped configuration fitting over each other to hold down the jack contacts,

BRIEF DESCRIPTION OF THE DRAWINGS

FIG. 5A is a side elevation view of a jack contact of the contact unit shown in FIG. 4;

DETAILED DESCRIPTION OF THE PREFERRED EMBODIMENT

Figure 1:
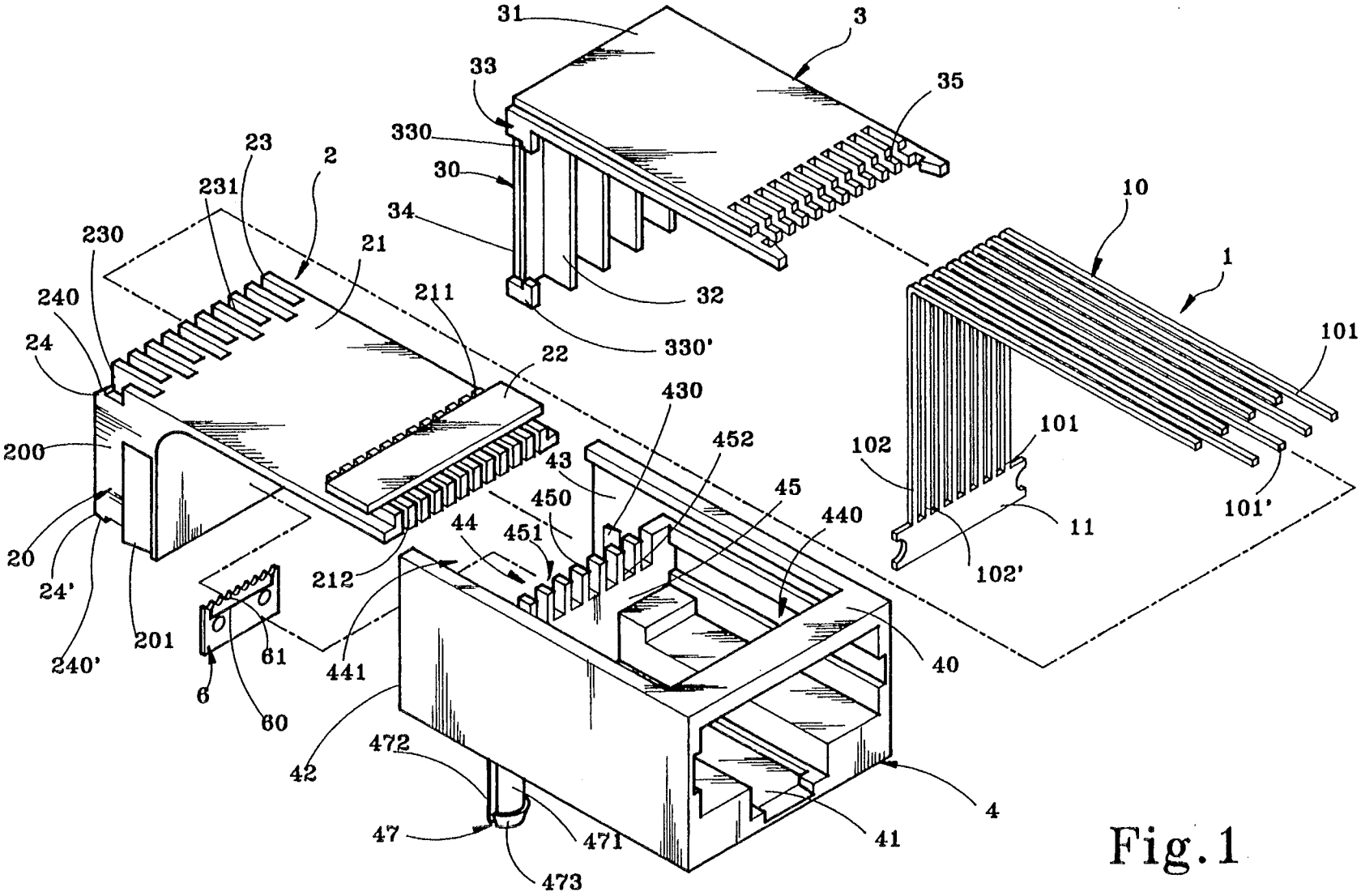
FIG. 1 is an exploded view of a jack according to the preferred embodiment of the present invention.
Figure 2:
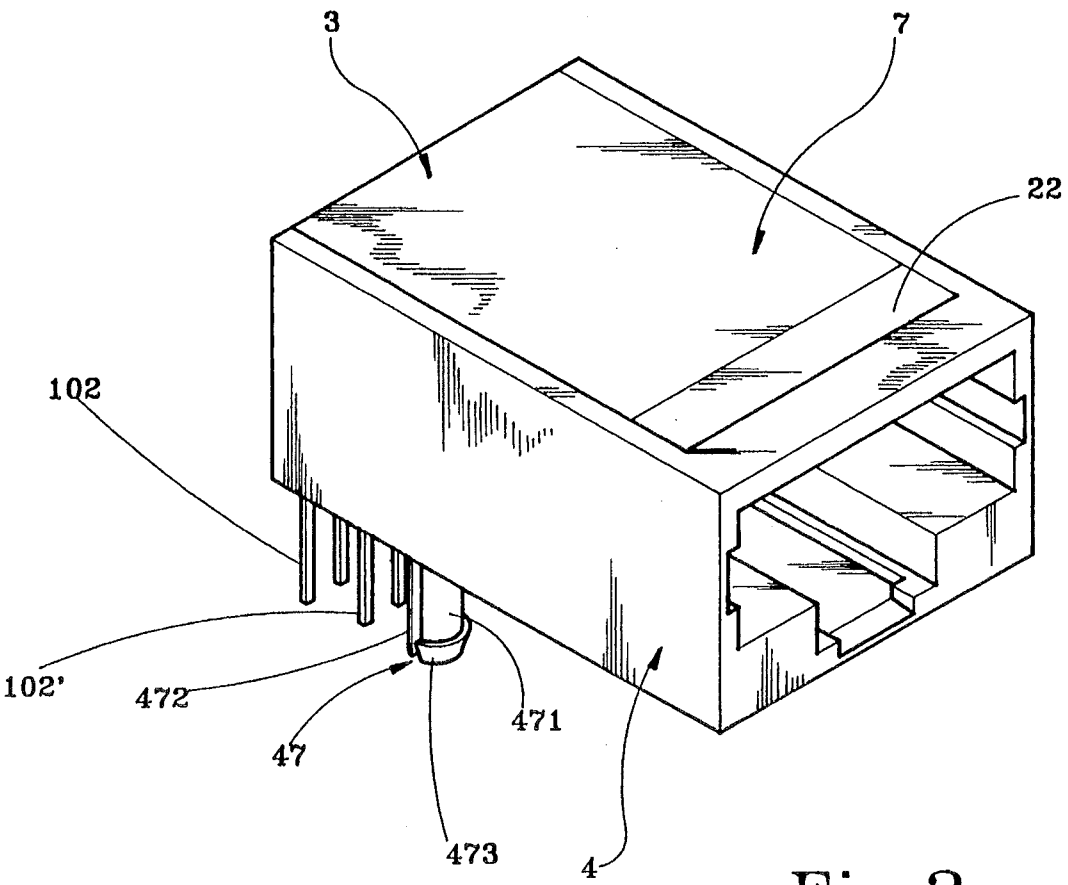
FIG. 2 is an elevational view of the jack shown in FIG. 1.
Figure 3:
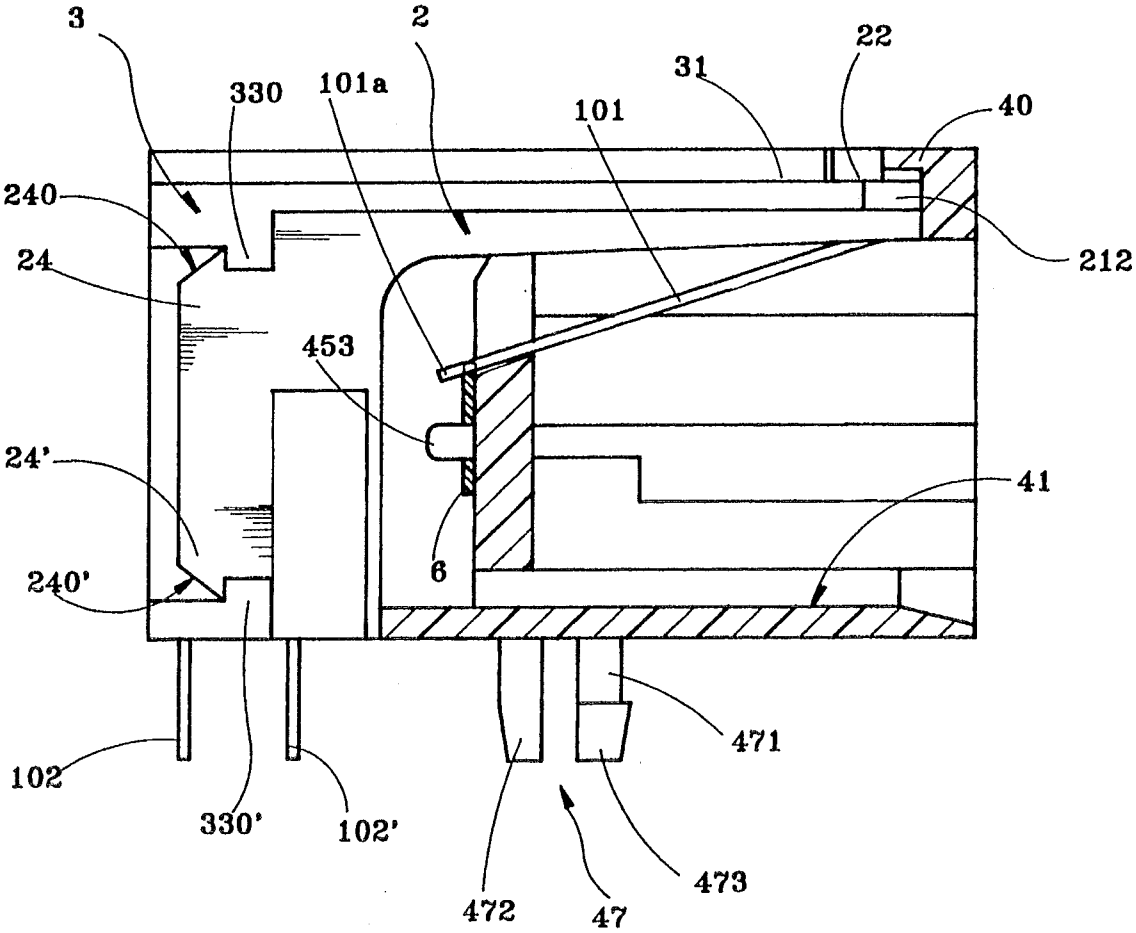
FIG. 3 is a longitudinal view in section of the jack shown in FIG. 2.

Referring to FIGS. 1, 2 and 3, a jack, referenced by 7, in accordance with the present invention is generally comprised of a contact unit 1, a contact holder 2, which holds the contact unit 1, a cover 3, which covers the contact holder 2, and a housing 4, which receives the contact unit 1, contact holder 2 and cover 3. When assembled, the contact portions 101;101' and mounting portions 102;102' of the contact unit 1 are disposed to the outside for connection to the printed circuit board and for receiving the modular plug respectively.

Figure 4A:
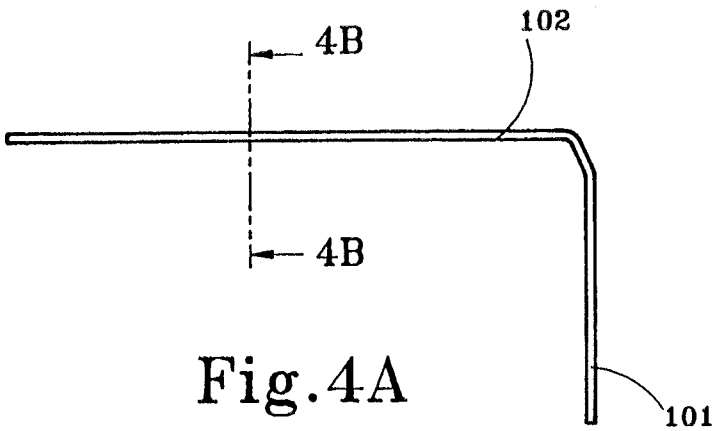
FIG. 4 shows a contact unit for use in the jack shown in FIG. 2.
FIG. 4B is a cross section of the jack contact shown in FIG. 4A.
Figure 4B:
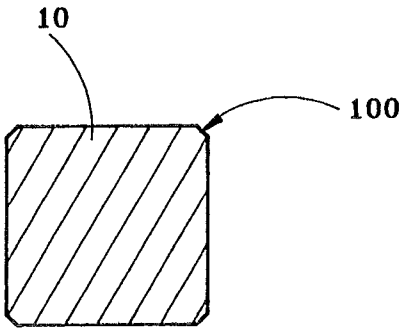
Figure 4:
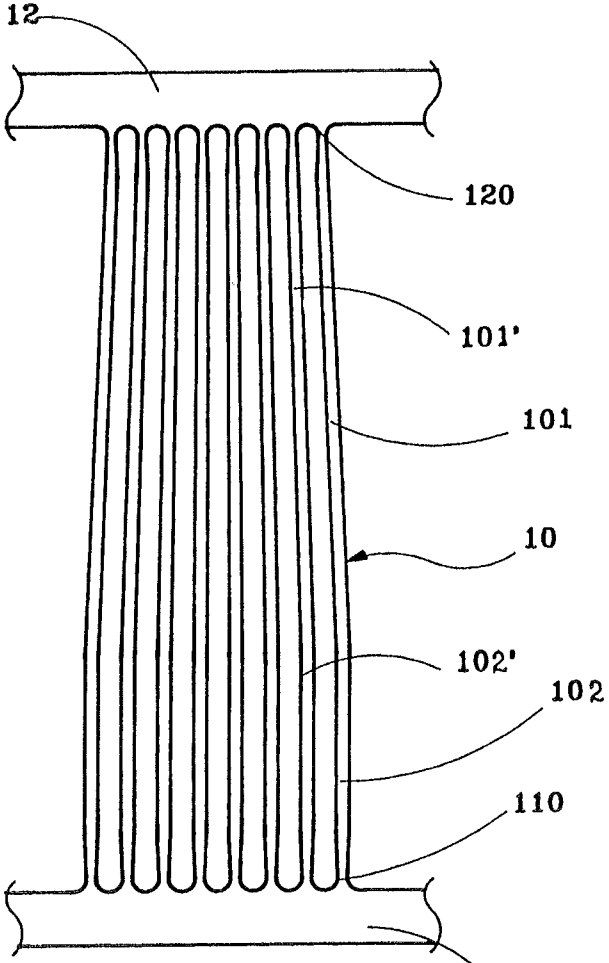

Referring to FIGS. 4, 4A and 4B, the contact unit 1 is made from a metal strip comprising a first coupling portion 11, a second coupling portion 12, and a row of separated jack contacts 10 connected between the first and second coupling portions 11;12. The jack contacts 10 are respectively divided into contact portions 101;101' and mounting portions 102;102'. The combined width of the mounting portions 102;102' is longer than the combined width of the contact portions 101;101'. The contact and mounting portions are respectively terminating in a respective neck portion 110 or 120 connected to the first or second coupling portion 11 or 12. Through the neck portions 110;120, the jack contacts 10 can be easily broken from the coupling portions 11;12. The jack contacts 10 are formed with a substantially rectangular cross-sectional configuration having circularly chamfered edges 100 around the four corners for quick installation.

Figure 10:
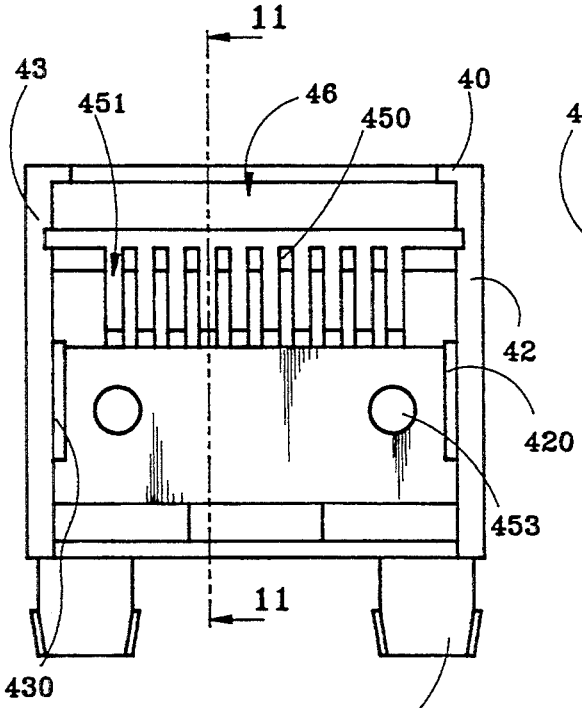
FIG. 10 is a front view of a housing for use in the jack shown in FIG. 2.
Figure 12:
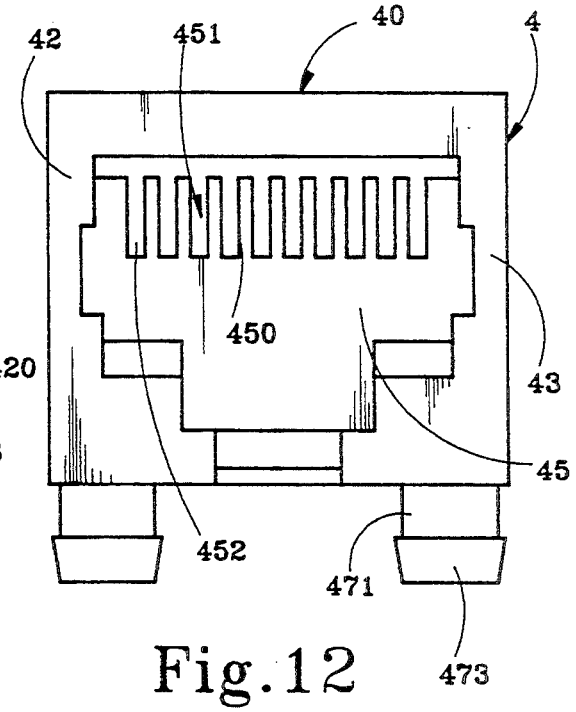
FIG. 12 is a back view of the housing shown in FIG. 10.
Figure 11:
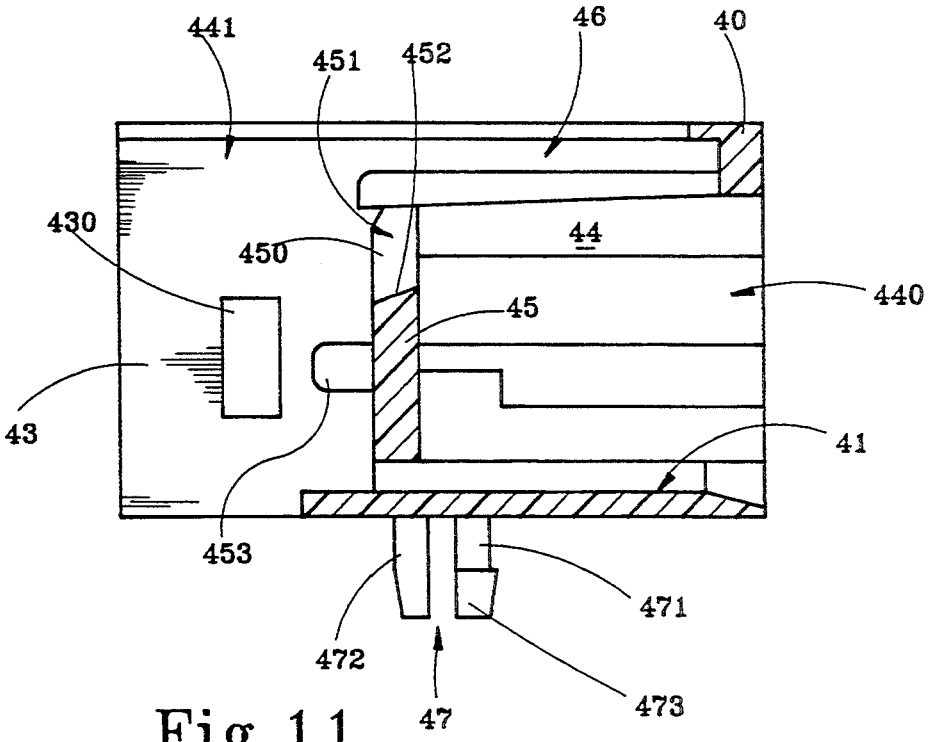
FIG. 11 is a longitudinal view in section of the housing shown in FIG. 10.

Referring to FIGS. 10, 11 and 12, and FIG. 1 again, the housing 4 comprises a top wall 40, a bottom wall 41, two opposite side walls 42;43, a transverse partition wall 45 in an inside space 44 thereof. The inside space 44 receives the contact unit 1, the contact holder 2 and the cover 3. The transverse partition wall 45 raises from the bottom wall 41, separating the inside space 44 into a front chamber 440 and a rear chamber 441. The transverse partition wall 45 comprises a row of fingers 450 spaced at the top between the side walls 42;43 by slots 451. The bottom 452 of each slot 451 respectively slopes from the front chamber 440 toward the rear chamber 441. The fingers 450 have the same height, and the topmost elevation of the fingers 450 is spaced from the elevation of the top wall 40 by a gap 46. The bottom wall 41 of the housing 4 comprises at least two mounting posts 47 at the bottom for mounting on the printed circuit board. As illustrated in FIG. 3, the mounting post 47 is longitudinally split into two symmetrical parts 471;472, one part 471 terminating in a hooked bottom end 473. When the mounting post 47 is inserted into a respective mounting hole on the printed circuit board, the hooked bottom end 472 becomes hooked on the bottom edge of the mounting hole, and therefore the mounting post 47 is installed.

Figure 5:
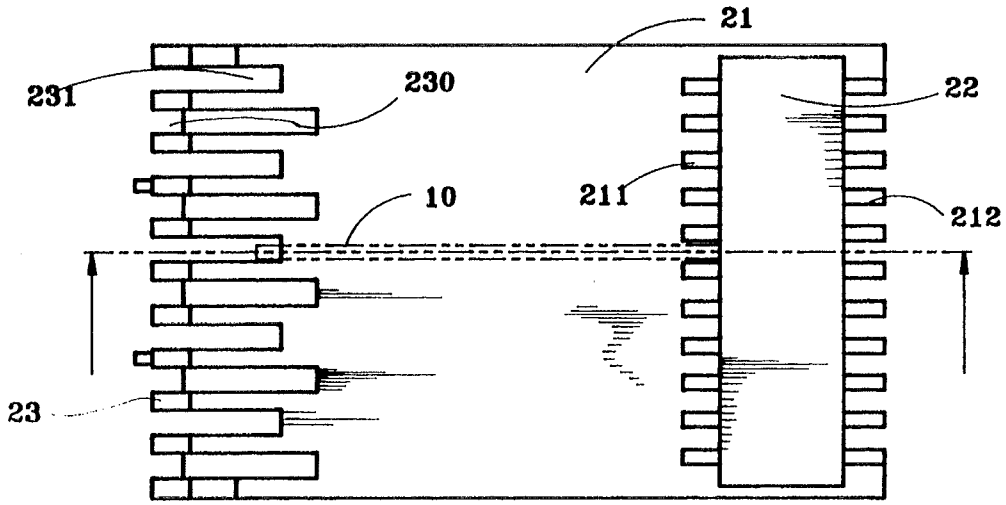
FIG. 5 is a top view of a contact holder for use in the jack shown in FIG. 2.
Figure 6:
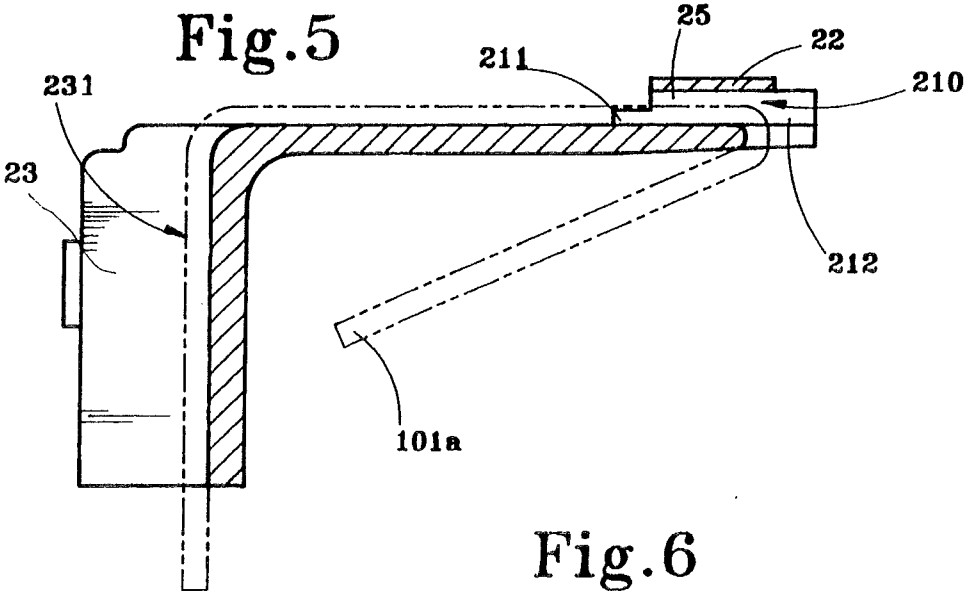
FIG. 6 is a front view of the contact holder shown in FIG. 5.
Figure 7:
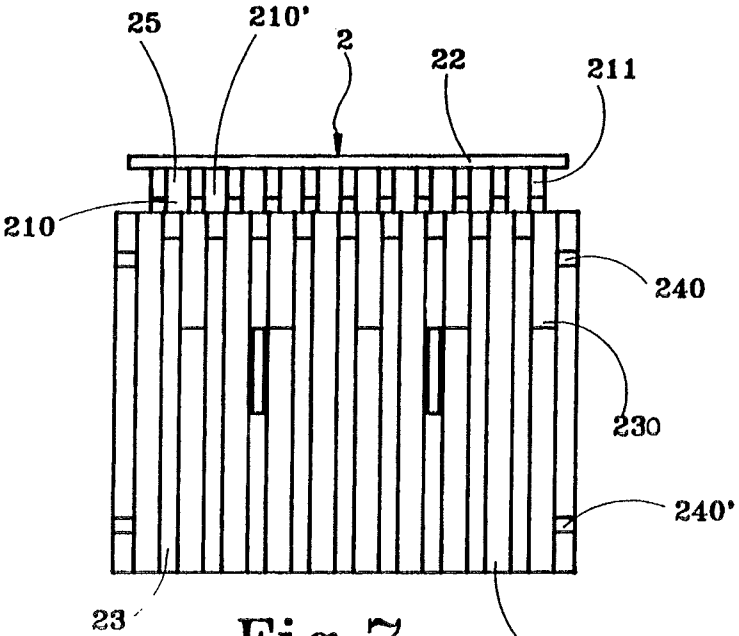
FIG. 7 is a side view of the contact holder shown in FIG. 5.
Figure 9:
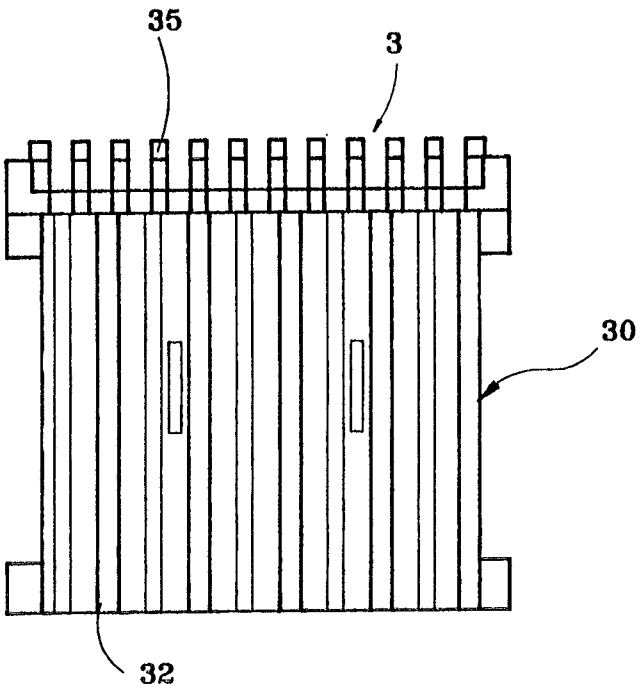
FIG. 9 is a side view of the cover shown in FIG. 8.
Figure 8:
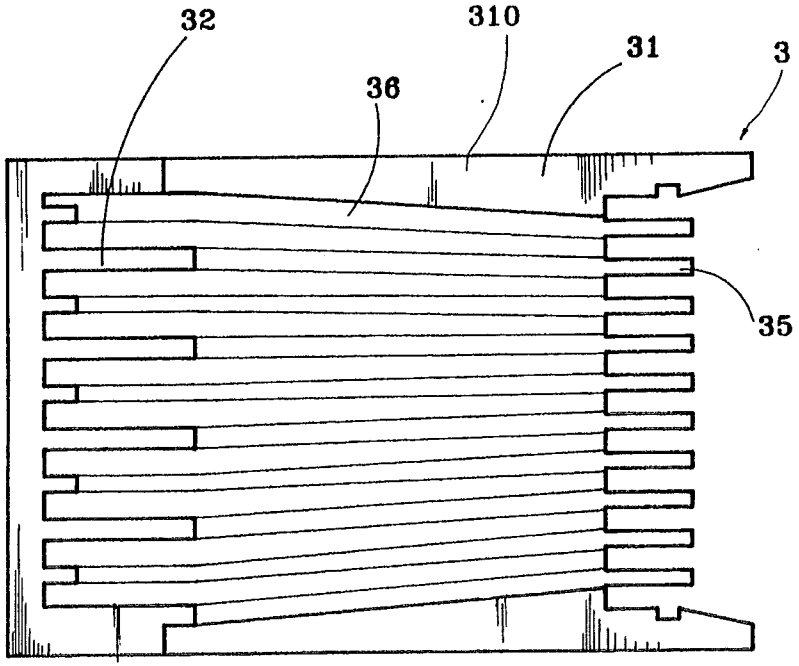
FIG. 8 is a bottom view of a cover for use in the jack shown in FIG. 2.

Referring to FIGS. 5, 6 and 7, the contact holder 2 is formed with a substantially L-shaped configuration, comprising a vertical base 20, and a horizontal top wall 21 perpendicularly extended from the vertical base 20 at the top. When the vertical base 20 of the contact holder 2 is inserted into the rear chamber 441 of the housing 4 along the horizontal direction, the horizontal top wall 21 passes through the gap 46 into the front chamber 440. The vertical base 20 comprises two forward sloping planes 201 on two opposite side walls 200 thereof. The forward sloping planes 201 are hooked by hooks 420;430 on the two opposite side walls 42;43 of the housing 4 when the contact holder 2 is inserted into the inside space 44. The transverse partition wall 45 further comprises a stop rod 453 projecting into the rear chamber 441 for mounting a ground circuit board 6 (See FIG. 3). The ground circuit board 6 has a series of notches 61 coated with a layer of contact metal for connecting the contact tip 101*a* of the contact portion 110 of either jack contact 10. The ground circuit board 6 is printed with a circuit 60 for short-circuiting either two or more jack contacts 10. The vertical base 20 comprises a plurality of grooves 230;231 on the outside surface thereof extended from the bottom to the top, which receive the jack contacts 10 respectively. The grooves 230;231 are alternatively arranged in two different depths. Therefore, when the jack contacts 10 are respectively inserted into the grooves 230;231, each two adjacent mounting portions 102;102' are disposed on two different planes. The depth of the shallow grooves 230 is deeper than the thickness of the mounting portions 102 of the jack contacts 10 so that the mounting portions 102 of the jack contacts 10 can be completely embedded on the inside. The horizontal top wall 21 of the contact holder 2 comprises a series of rails 211 separated from one another by rectangular contact passage holes 210;210' and terminating in finger portions 212, and a horizontal top board 22 covered over the rails 211 and the rectangular contact passage holes 210;210'. The height of the rectangular contact passage holes 210;210' must be longer than the thickness of the contact portions 01;101' of the jack contacts, and therefore a gap 25 is left in each rectangular contact passage hole 210 or 210' beneath the horizontal top board 22 when the contact portions 101;101' are respectively inserted into the rectangular contact passage holes 210;210'. During the assembly process, the second coupling portion 102 is separated from the jack contacts 10, then the contact portions 101;101' of the jack contacts 10 are respectively inserted into the rectangular contact passage holes 210;210', and then the mounting portions 102;102' are bent downwards and embedded in the grooves 30;231 on the vertical base 20. When the contact portions 101;101' are respectively inserted into the rectangular contact passage holes 10;210', some of them will protrude beyond the finger portions 212. The contact tips 101*a* of the contact portions 101 which protrude beyond the finger portions 212 are then bent downward and backward toward the vertical base 20, permitting the contact tips 101*a* to pass through the slots 451 on the transverse partition wall 45 for connecting the modular plug. The arrangement of the finger portions 212 prohibits either two adjacent contact tips 101*a* from being short-circuited. After the installation of the contact holder 2, the cover 3 is fastened to the housing 4 and covered on the contact holder 2.

The cover 3 is formed with a substantially L-shaped configuration comprised of a vertical wall 30 and a horizontal wall 31 perpendicularly extended from the vertical wall 30 at the top. The vertical wall 30 comprises a plurality of projecting strips 32 longitudinally disposed at an inner side and respectively fitted into the grooves 230;231 on the vertical base 20 of the contact holder 2 to hold down the mounting portions 102;102 of the jack contacts 10, two retainer devices 33 on two opposite lateral sides 34 thereof fastened to vertical base 20 of the contact holder 2. The retainer device 33 at either lateral side 34 comprises two hooked portions 330;330' spaced at different elevations. The hooked portions 330;330' of the two retainer devices 33 are hooked up with respective hooked portions 24;24' on the vertical base 20 of the contact holder 2 when the projecting strips 32 are respectively fitted into the grooves 230;231, and therefore the vertical wall 30 of the cover 3 does not disconnect from the vertical base 20 of the contact holder 2. The hooked portions 24;24' have a respective slope 240 or 240', which guides the respective hooked portion 330 or 330' into the hooked position. The horizontal wall 31 of the cover 3 comprises a plurality of finger portions 35 respectively fitted into the gaps 25 in the rectangular contact passage holes 210;210' to hold down the contact portions 101;101' of the jack contacts 10, and a plurality of guide grooves 36 on the bottom surface 310 thereof, which receive the contact portions 101 of the jack contacts 10 as the contact portions 101 are bent downwardly backward and inserted into the slots 451 on the transverse partition wall 45.

When the jack 7 is assembled, the first coupling portion 11 of the contact unit 1 is separated from the jack contacts 10, and therefore the jack contacts 10 are separately disposed in the housing 4 for installation.

I claim:

1. A jack for a modular plug adapted for connection to a printed circuit board, comprising a substantially rectangular housing having an inside space divided into a front chamber and a rear chamber by a transverse partition wall thereof, a plurality of jack contacts a contact holder bridged over said transverse partition wall to hold said jack contacts in the inside space of said housing, and a cover fastened to said housing and covered over said contact holder to hold down said jack contacts, said transverse partition wall of said housing comprising a plurality of fingers at the top spaced from one another by slots and from the topmost edge of said housing by a horizontal gap, wherein:

said jack contacts are separated from a metal contact plate comprising a first coupling portion, a second coupling portion, and a row of separated jack contacts connected between said first and second coupling portions, said jack contacts being respectively divided into mounting portions connected to said first coupling portion and contact portions connected to said second coupling portion, said mounting portions being equally spaced from one another for connection to a printed circuit board by welding, the space between either two adjacent contact portions being made gradually smaller toward said second coupling portion;

said contact holder comprises a vertical base fitted into said rear chamber of said housing, and a horizontal top wall perpendicularly extended from said vertical base at the top and inserted into said horizontal gap, said vertical base of said contact holder comprising a plurality of grooves on an outer surface thereof extended from the bottom to the top, which receive said jack contacts respectively, and hooked portions spaced on two opposite lateral side walls thereof at different elevations, which hold said cover in position, the horizontal top wall of said contact holder comprising a series of rectangular contact passage holes; and said cover comprises a vertical wall and a horizontal wall perpendicularly extended from the vertical wall of said cover at the top, the vertical wall of said cover comprising a plurality of projecting strips respectively fitted into the grooves on the vertical base of said contact holder to hold down the mounting portions of said jack contacts, hooked portions disposed on two opposite lateral sides thereof at two different elevations and respectively hooked up with the hooked portions on the vertical base of said contact holder, the horizontal wall of said cover comprising a plurality of finger portions respectively fitted into the contact passage holes on the horizontal top wall of said contact holder to hold down the contact portions of said jack contacts, and a plurality of guide grooves on a bottom surface thereof, through which the tips of the contact portions of said jack contacts pass.

2. The jack of claim 1 wherein the rectangular contact passage holes on the horizontal top wall of said contact holder are defined by a plurality of rails and a horizontal top board covered over said rails, said rails raising from the horizontal top wall of said contact holder and terminating in a respective finger portion.

3. The jack of claim 1 wherein said jack contacts have each two opposite ends respectively connected to said first and second coupling portions by a respective neck portion, through which said jack contacts are broken from said first or second coupling portion.

4. The jack of claim 1 wherein the grooves on the vertical base of said contact holder are alternatively arranged in two different depths permitting the mounting portions of said jack contacts to be disposed at different vertical planes.

5. The jack of claim 4 wherein the depth of the shallow grooves on the vertical base of said contact holder is deeper than the thickness of the mounting portions of said jack contacts so that the mounting portions are completely embedded within the grooves.

* * * * *